US006851140B2

(12) United States Patent
Polevoy et al.

(10) Patent No.: US 6,851,140 B2
(45) Date of Patent: Feb. 8, 2005

(54) BED FRAME CENTER BEAM LOCKING MECHANISM

(75) Inventors: Richard S. Polevoy, Teaneck, NJ (US); Howard Scott Ryan, Skaneateles, NY (US); Paul Eric Carlson, Skaneateles, NY (US)

(73) Assignee: Finger Lakes Intellectual Property LLC, Teaneck, NJ (US)

( * ) Notice: Subject to any disclaimer, the term of this patent is extended or adjusted under 35 U.S.C. 154(b) by 0 days.

(21) Appl. No.: 10/364,914

(22) Filed: Feb. 11, 2003

(65) Prior Publication Data

US 2003/0200608 A1 Oct. 30, 2003

Related U.S. Application Data

(60) Provisional application No. 60/355,859, filed on Feb. 11, 2002.

(51) Int. Cl.[7] ..... A47C 19/04

(52) U.S. Cl. ..... 5/200.1; 5/201; 5/202; 5/282.1; 5/285; 5/286; 5/185

(58) Field of Search ..... 5/200.1, 201, 202, 5/206, 207, 208, 282.1, 285, 286, 181, 186, 907

(56) References Cited

U.S. PATENT DOCUMENTS 3,123,837 A * 3/1964 Paine et al. ..... 5/181
3,736,602 A * 6/1973 Miller ..... 5/176.1
4,027,343 A * 6/1977 Hooker ..... 5/200.1
4,106,141 A * 8/1978 Hooker ..... 5/201
5,161,268 A * 11/1992 Harrow ..... 5/201
5,243,720 A * 9/1993 Harrow ..... 5/201
6,209,155 B1 * 4/2001 Epstein et al. ..... 5/201
2003/0097714 A1 * 5/2003 Polevoy et al. ..... 5/663

* cited by examiner

*Primary Examiner*—Michael Trettel
(74) *Attorney, Agent, or Firm*—Klauber & Jackson

(57) ABSTRACT

A locking mechanism for securing a center beam of a bed frame to the cross bars that enable the assembler to complete the assembly of the bed frame completely without the need for hand tools or securing implements to aid in the assembly. With a queen size bed frame or smaller, the cross bar members are joined together in overlapping manner to form cross bars and the center beam is secured to the cross bars by use of the present locking mechanism. In the case of a king size or a California king size bed frame, a universal extension bar is provided that can be used to join the cross bar members of either size bed frame and a extension cap is also provided that is affixed to the universal extension bar having indicia that instructs the assembler in the proper assembly of the particular bed frame.

43 Claims, 9 Drawing Sheets

BED FRAME CENTER BEAM LOCKING MECHANISM

CROSS-REFERENCE TO RELATED APPLICATIONS

The present application is based upon U.S. Provisional patent application 60/355,859, filed Feb. 11, 2002 and entitled "BED FRAME CENTER BEAM LOCKING MECHANISM".

BACKGROUND OF THE INVENTION

The present invention relates to bed frames, and, more particularly, to a mechanism that facilitates the interconnection of a center beam in setting up a bed frame.

In general, bed frames are comprised of a pair of side rails and a plurality of cross bars that span between the side rails in order to assemble and complete the bed frame structure. The bed frame, once assembled is adapted to support a box spring and a mattress to make up the bed itself. Normally, therefore, the bed frame assembly is shipped and delivered unassembled for convenience and general transportation and the two side rails comprise L-shaped steel members. The cross bars are formed of cross bar members that are pivotally affixed at or near each end of the side rails. In the assembly of the bed frame at the location of the customer, therefore, the cross bar members are interfitted with and parallel to the side rails for ease of shipment and the cross bar members are pivoted about 90 degrees so as to extend generally at a right angle from the side rails and the opposite, free ends of the cross bar members are affixed together at the center area of the bed frame to form cross bars that thus span between each of the side rails. As such, when so assembled and affixed together, the bed frame assumes a generally rectangular configuration to accept the box spring and the mattress.

There is also, normally, a center beam that is positioned so as to be generally parallel to the side rails and which is located at or near the center of the bed frame in order to provide additional support to the overall structure and, of course to the box spring and mattress. In the assembly of the bed frame for a queen size bed, for example, each of the pivotable cross bar members are rotated with respect to the side rails so as to extend at a right angle and then the free ends affixed together to form cross bars. One common means for affixing the free ends of the cross bar members together is through the use of one or more standoff rivets on one of the mating cross bar members and a corresponding set of one or more keyhole slots formed in the other mating cross bar member. The standoff rivets are inserted through the enlarged area of the keyhole slots and relative movement between the mating cross bar members causes the standoff rivets to be moved and repositioned at the smaller end of the keyhole slots where the unit is affixed together. When the center beam is thereafter added to the bed frame, screws are inserted through the then mated cross bar members to form a cross bar in order to prevent the further relative movement between the cross bar members as well as to secure the center beam into the bed frame to finalize the task of assembling that bed frame.

Accordingly, to fully and completely carry out the assembly of the aforedescribed bed frame, it is necessary for the assembler to utilize hand tools to assemble the overall bed frame in tightening the screws and, obviously, it is also necessary for the bed frame supplier to provide individual screws to be affixed to Tinnerman clips, or simply nuts and bolts along with the other more major components of the bed frame to facilitate the assembly. In some cases, the nuts themselves may be held captive in the assembly and therefore are not needed as separate components, i.e. the Tinnerman clips, however in such case, the screws still need to be supplied along with the assembly and tools needed to tighten the screws, even if the Tinnerman clips are captive. It would still, therefore, be advantageous from the standpoint of both the assembler as well as the bed frame supplier to eliminate the need for hand tools and the supplying of bolts and nuts or screws with the bed frame assembly.

In the case of a king size bed or a California king size bed, there is also the need for an extension bar to span between the interconnecting cross bar members in order to achieve the required length of the assembled cross bars to properly span the distance between the side rails to accommodate the larger size box spring and mattress. The use of an extension bar is necessary due to the added width of the box spring and mattress for a king or California king size bed in order to be able to use standard length of cross bars. Otherwise, if the cross bars were deliberately made to be of sufficient lengths for a king or California king size bed, they would be too long to be used with a small bed frame as they would extend outwardly beyond the normal width of those bed frames, that is, the cross bars would need to extend longer than the width of small bed frame.

Thus the extension bar is provided to add the additional length to the interconnecting cross bar members in order to provide the necessary width to the king or California king bed frame and to enable the manufacture to use the same length of cross bar members for all sizes of bed frame. In that manner, the cross bar members can be the same length as with the queen size bed frame rather that have specially sized cross bar members for each bed frame configuration. As can therefore be recognized, since the cross bar members themselves are of a standard length, there is then needed, two differing lengths of extension bars to construct the king and California king size bed frames.

Accordingly the differing length extension bars for the king and California king size bed frames require the supplier to maintain an inventory of each of the extension bars to be shipped depending on the particular frame size, thereby creating an inventory, labeling and identification problem and also raising the possibility that the wrong extension bar can be sent to the customer and incur the annoyance of that customer and the need to spend time to correct the problem. In addition, the assembly of the bed frame for the king and California king sizes, as with the prior description, still requires the use of hand tools as well as the supplying of the proper bolts, nuts or screws to the customer to carry out the assembly of the bed frame.

It thus would be advantageous to have a bed frame assembly that would avoid the problem requiring hand tools for the affixing of the cross bar members together to form a cross bar and also for the further assembly of the center beam to the cross bars in completing the assembly of a bed frame. In addition, it would be advantageous to have a common or universal extension bar that is equally adaptable for use with a king size bed frame or a California king size bed frame so that only one extension bar need be supplied with either of those sizes of bed frames and also to have some indicia associated with the universal extension bar to facilitate the proper assembly of the king or California king size bed frames to assure that the ultimate width of the assembled bed frame is the proper dimension to accommodate the king or California king size box spring and mattress.

SUMMARY OF THE INVENTION

Now, in accordance with the present invention, there is provided a bed frame construction featuring a center beam locking mechanism adapted to facilitate the assembly of a bed frame and which enables the complete assembly of the bed frame without the use of hand tools or additional bolts, nuts or screws, or the like whether the bed frame is in the configuration of a queen size or smaller or is a king size or California king size bed frame.

The locking mechanism of the present invention comprises a frame, preferably of a formed metal construction, and which is affixed to each end of a center beam used in the construction of a bed frame. An overlap flange extends outwardly from the frame and, in the affixing of the center beam to a cross bar, the overlap flange is adapted to abut against the external surface of the cross bar. The frame also includes a slot formed therein, preferable two of such slots displaced apart, and one or more pawls moves so as to be guided by the slots such that the pawls can move between two positions, a locked position where the pawls firmly engage the internal surface of the cross bar and sandwich the cross bar between the pawls and the overlap flange to secure the center beam to the cross bar and an unlocked position where the pawls are displaced away from that internal surface of the cross bar.

A lever arm is pivotally affixed to the frame and is also movably affixed to the ends of the pawls. By rotating the lever arm, the pawls are caused to move between their locked and unlocked positions and an overcenter, toggle mechanism causes the pawls to become locked in their locked positions so as to firmly affix the center beam to the cross bars in the assembly of the bed frame. Accordingly, by use of the present mechanism, the center beam can be affixed securely to the cross bars of the bed frame without the need for any screws of other devices that would require hand tools by the assembler. In order to assure the proper alignment of the center beam, there are also a number of bent tabs that extend downwardly from the locking mechanism frame and which enter prealigned holes in the cross bar to be assured that the position of the center beam is proper with respect to the cross bars.

In the case of a king size or California king size bed frame, the center beam locking mechanism is used to affix the center beam to an extension bar, however, the extension bar of the present invention is designed to be a universal extension bar and the same extension bar is used for both the king size bed frame as well as the California king size bed frame. Thus, as in the prior art, an extension bar is used to join the cross bar members to complete the cross bar in assembling the bed frame, however with the universal extension, there are different sets of standoff rivets and keyhole slots so that the assembler can select the appropriate set of standoff rivets and keyhole slots applicable for the particular bed size that is desired.

In order to aid the assembler in selecting the correct set or sets of keyhole slots to interfit with the appropriate standoff rivets, an extension cap, preferably comprised of a plastic material, is provided that, in the preferred embodiment, can simply be snapped on to the universal extension bar and which provides indicia, either in written form or by appropriate color, or both, to clearly indicate to the assembler what standoff rivets interfit with the appropriate sets of keyhole slots to make up either a king size bed frame or a California king size bed frame. By the use of the plastic extension cap, therefore, the assembler can easily and quickly make the correct connections between the mating standoff rivets and the keyhole slots to assemble the bed frame for either the king size or the California king size bed frames and be assured that the extension bar and the center beam is correctly installed.

In the same embodiment, there are bent tabs that extend downwardly from the center beam locking mechanism and which interfit with appropriate holes formed in the universal locking bar, and again, there is indicia provided on an extension cap affixed to the universal extension bar to clearly indicate to the assembler, which are the appropriate and correct holes or sets of holes to be interfitted with the set of tabs to properly align the center beam for those bed frame sizes, that is, for the king or California king size bed frame. Thus, with the extension cap, not only can the assembler correctly determine the proper sets of standoff rivets to interfit with a set of keyhole slots, but the alignment and positioning of the center beam is also assured by the indicia on the extension cap clearly indicating to the assembler the correct holes on the universal extension bar into which the downwardly extending tabs are to be inserted.

As a still further feature of the present extension cap, the center beam locking mechanism of the present invention is intended to sandwich a double thickness of the legs of an angle iron used in the cross bar members inasmuch as the present locking mechanism is affixed to the overlapping cross bar members and thus there is a double thickness of the angle iron. With the use of the extension bar for the king or California king size bed frames, there is no overlapping of the cross bars and the center beam is affixed to the extension bar. Thus by adding the extension cap to the extension bar, the thickness of the extension cap is added to the normal thickness of the extension bar and that double thickness is then sandwiched between the pawls and the overlap flange so that the same dimensioned center beam locking mechanism can be used with the king and California king size bed frames as well as the queen and smaller bed frames.

Other features of the present center beam locking mechanism and resultant bed frame will become more apparent in light of the following detailed description of a preferred embodiment thereof and as illustrated in the accompanying drawings.

DETAILED DESCRIPTION OF THE INVENTION

Figure 1:
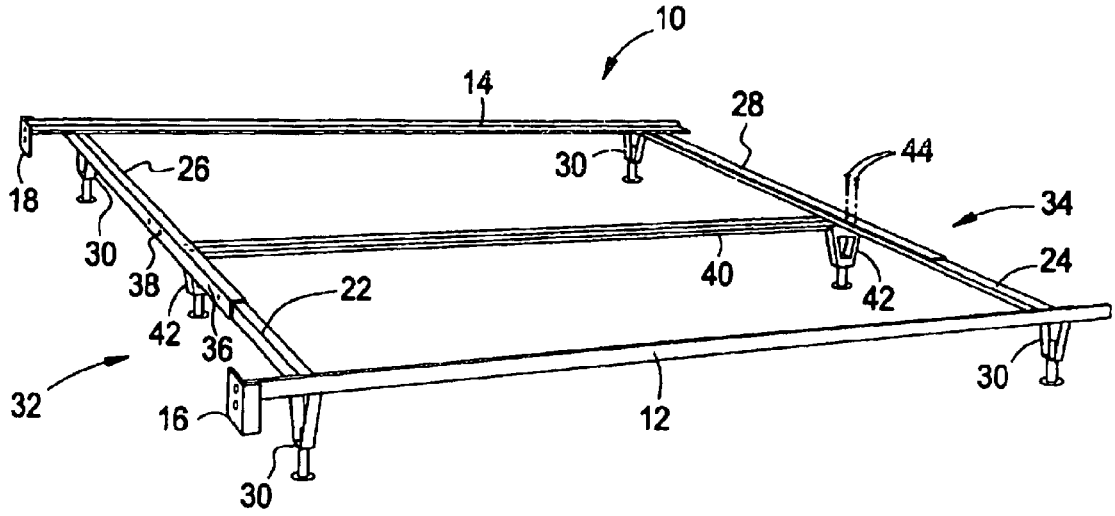
FIG. 1 PRIOR ART
FIG. 1 is a perspective view of a conventional bed frame used for a queen size and smaller configurations.

Referring now to FIG. 1, there is shown a perspective view of a conventional bed frame 10 and is typical of a bed frame that is a queen size or smaller. In the Figure, there are a pair of side rails 12, 14 that are normally L-shaped steel members and at one end thereof, there are normally located brackets 16, 18 to aid in the attachment of a headboard to the side rails 12, 14. To make up the bed frame 10, there are also cross bar members 22, 24, 26 and 28 that extend outwardly from side rails 12, 14 at about a right angle. As explained, for the convenience of handling and transportation of the components of a bed frame 10, the cross bar members 22, 24, 26 28 are pivotally mounted to the side rails 12, 14, that is, cross bar members 22 and 24 are pivotally mounted to the ends of side rail 12 while cross bar members 26 and 28 are pivotally affixed to the ends of side rail 14. As an example, therefore, during shipment, the cross bar members 22 and 24 are positioned 90 degrees from the orientation shown in FIG. 1 and rest parallel to and abut against the side rail 12 and, during assembly, the cross bar members 22 and 24 are rotated about 90 degrees to the position as shown.

Legs 30 extend downwardly from each of the cross bar members 22, 24, 26, 28 generally at the pivot point between the cross bar member and the side rails 12, 14 and the legs 30 thereby provide the support for the bed frame 10 after the assembly thereof. As shown, the legs 30 are provided with glides that contact the floor, however, it can be seen that there may be rollers affixed to the underside of the legs that allow the bed frame to freely roll along the floor, and such rollers can be of the type shown and described in U.S. patent application Ser. No. 09/519,725, filed Mar. 3, 2000, entitled "CASTER ASSEMBLY FOR A BED FRAME MEMBER OR FURNITURE" and assigned to the assignee of the present invention.

Thus, during the assembly of the bed frame 10, the assembler rotates the cross bar members, 22, 26, for example, and affixes the free ends of those cross bar members 22, 26 together at about the center of the bed frame 10 in order to complete a cross bar 32. Since the same procedure will be used for the formation of the other cross bar 34, only the cross bar 32 will be hereinafter described in detail. The means for carrying out the joining of the cross members 22 and 26 together may be by a variety of mechanisms, one of which is shown in FIG. 1 and where one of the cross bar member 22 has a set or plurality of standoff rivets 36 facing outwardly and which interfit into a corresponding set of keyhole slots 38 formed in the mating cross member 26 by inserting the standoff rivets 36 through the enlarged area of the keyhole slots 38 and then moving one of the cross bar member 22, 26 relative to the other to slide the standoff rivets 36 into the narrow area of the keyhole slots 38 to secure the cross bar member 22 and 26 together. As indicated, the same procedure is used to secure the cross bar member 24 and 28 together in order to form the cross bar 34.

A center beam 40 is added to complete the bed frame 10 and which also has a pair of legs 42 and which provide overall support for the cross bars 32, 34 at the center of the bed frame 10. As can be seen, the center beam 40 spans between the two cross bars 32, 34 and is normally secured by means of screws 44 that are threaded into nuts, not shown, and which secure the center beam 40 to the cross bars 32, 34 as well as to secure the cross bar member 22, 26 and 24, 28 together to prevent relative motion between the mating cross bar member that might allow the cross bar members to come apart. As indicated, the use of screws adds a complication, however, as the assembler then needs to have tools to secure the bed frame 10 together and also the supplier needs to ship the appropriate bolts and mating nuts, if captive nuts or Tinnerman clips are not used, along with each bed frame 10.

Figure 2:
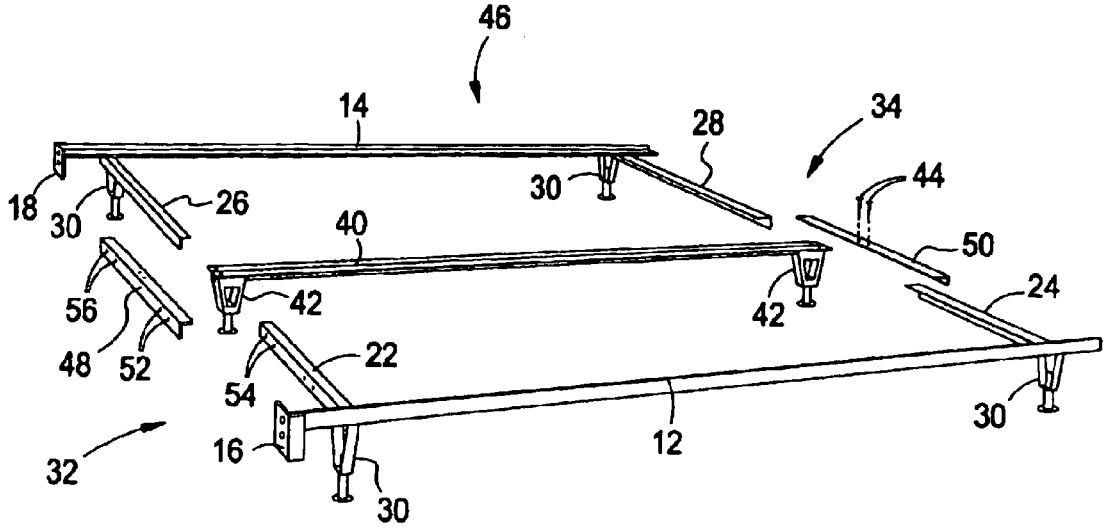
FIG. 2 PRIOR ART
FIG. 2 is a perspective view of a conventional bed frame for a king or California king size configuration.

Turning now to FIG. 2, there is shown a perspective view of a bed frame 46 that is a larger size than depicted in FIG. 1, that is, the FIG. 2 embodiment is a bed frame 46 suitable for a king size or California king size bed. In FIG. 2, many of the components are the same as that shown and described with respect to FIG. 1 and therefore the same numbers have been used on the common components and the set up and assembly is carried out basically the same as in reference to FIG. 1. With the additional width necessary, however, for a king size or California king size bed, there are extension bars 48, 50 that are used to span between mating cross bar member, for example, between cross bar member 22 and 26, the extension bar 48 is added and which is affixed to both the cross bar member 22 and the cross bar member 26 to join those two cross bar members together with the additional width or span between the side rails 12 and 14 supplied by the length of the extension bar 48.

Accordingly, in the assembly of the FIG. 2 embodiment, the assembler simply adds the two extension bars 48, 50 by affixing them to the respective cross bar members 22, 26 and 24, 28. The means of affixation may be the same as used in attaching together the FIG. 1 cross bar member, that is, the extension bar 48, using it as an example, can have a set of standoff rivets 52 that interfit into the keyhole slots 54, shown formed in the cross member 22 while at the other end of the extension bar 48, there is a corresponding set of keyhole slots 56 formed in the extension bar 48 that interfit with a set of two standoff rivets (not shown) on the cross member 26. Thus, again by the slight relative movement between the extension bar 48 and each of the cross bar members 22, 26, the extension bar 48 can be locked into place extending the distance spanned by the cross bar members 22, 26. As such, the cross bar members 22, 26 can be the same length as in the FIG. 1 embodiment for small beds, so that the cross bar members can be dimensionally the same for the small bed frames as well as the king and California king size bed frames.

Again, however screws 44 are used to secure the center beam 40 to the cross bars 32, 34 and therefore the FIG. 2 embodiment suffers from the same need for hand tools in the assembly of the bed frame as the FIG. 1 embodiment and additionally, the use of the extension bars 48, 50 require that the supplier have different extension bars to be supplied with the bed frames depending on whether a king size or a California king size bed frame is being supplied to the customer.

Figure 3:
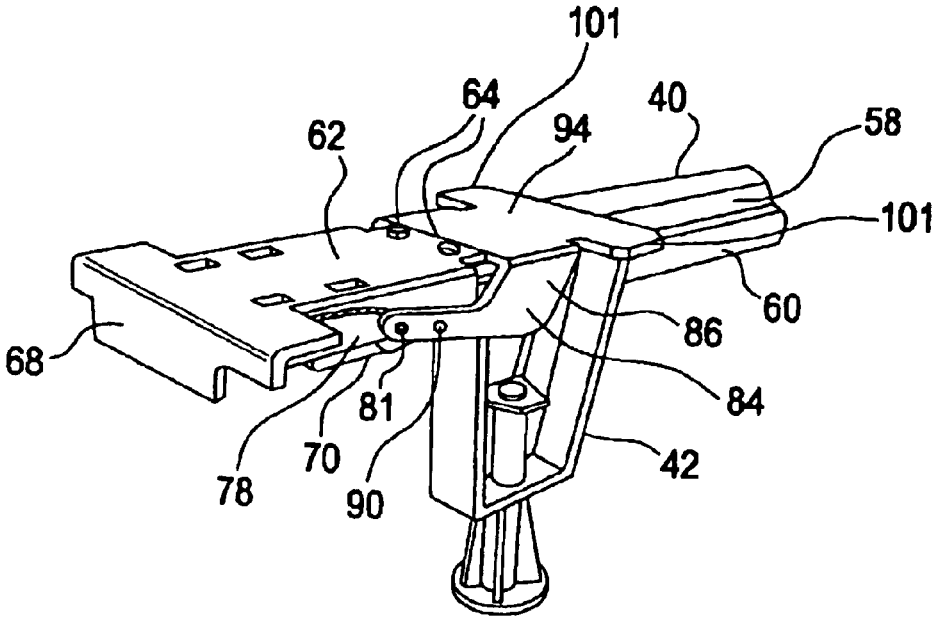
FIG. 3 is an upper perspective view of a center beam locking mechanism, constructed in accordance with the present invention.
Figure 4:
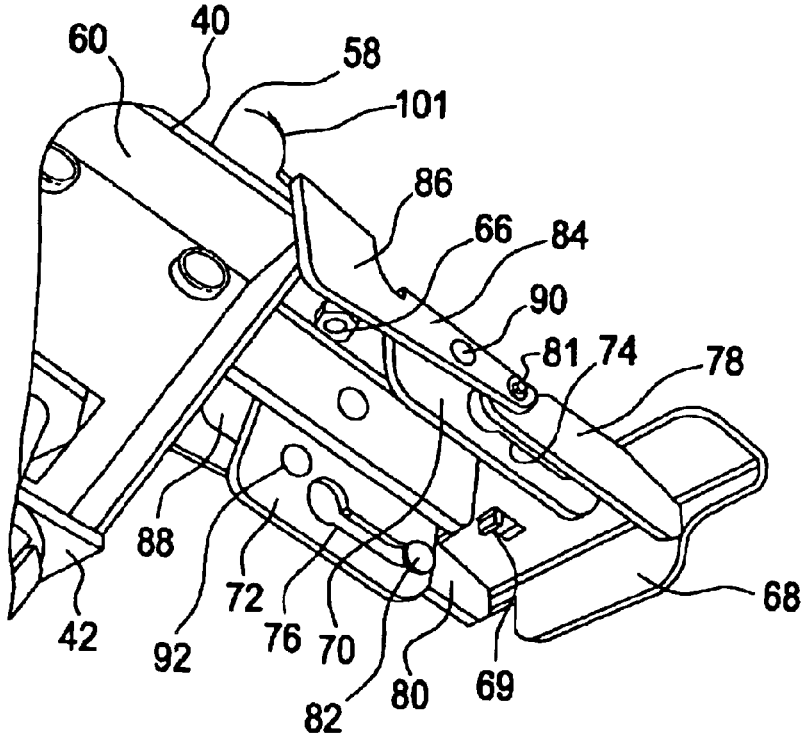
FIG. 4 is a lower perspective view of the center beam locking mechanism of FIG. 3.

Turning now to FIGS. 3 and 4, there are shown perspective views, taken from above and below, respectively, of a center beam locking mechanism constructed in accordance with the present invention. As can be seen, the center beam 40 is shaped in the form of a tee, having an upper, planar surface 58 and a downwardly extending central leg 60. The locking mechanism is affixed to both of the ends of the center beam 40 and one of the ends is shown in FIGS. 3 and 4 for illustrative purposes. The center beam locking mechanism includes a frame 62 that is affixed to the end of the center beam 40 and that affixation may be by means of rivets or by bolts 64, secured by nuts 66. Alternatively, and even preferably, that securing can be accomplished by means of rivets. It should be noted, that when bolts and nuts are so used, they are installed and secured at the factory such that no assembly is required of the cross beam locking mechanism to the center beam 40 at the location of the customer where tools would be required for the assembly of the overall bed frame.

As an integral part of the frame 62, there is an overlapping flange 68 that extends outwardly with respect to the end of the center beam 40 and, as will be seen, overlaps the cross bar in carrying out the assembly of a bed frame. The overlapping flange 68 is preferably sufficiently wide so as to provide a strong structure so as to reduce the possibility of twisting taking place between the center beam 40 and a cross bar member, the purpose of which will later become clear. A bent tab 69 is also formed in the lower surface of the frame 62 and preferable there are two of such bent tabs 69, only one of which is shown in FIG. 4 and the purpose of the bent tab 69, or tabs, will be later explained. The frame 62 is preferable an inverted U-shaped configuration having a pair of downwardly extending plates 70, 72 encompassing each side of the upper planar surface 58 of the center beam 40. Each of the plates 70,72 has an elongated opening 74,76 formed therein in a generally J-shaped configuration. A pair of pawls 78, 80 are provided in a plane generally parallel to and external of the plates 70, 72 and each of the pawls 78, 80 has a projection, such as a standoff rivet 82, only one of which is shown in FIG. 4, such that the standoff rivets 82 are captured within the elongated openings and, as will be seen, guide the movement of the pawls 78, 80.

A lever arm 84 is also a part of the locking mechanism of the invention and the lever arm 84 is bifurcated and each of the sides 86, 88 thereof is pivotally affixed to the frame 62 at the pivot points 90 such that the lever arm 84 can rotatably pivot about those points. Each of the sides 86,88 of the lever arm 84 is, in turn, pivotally affixed, at point 81, to an inner end of each of the pawls 78, 80. A flat plate 94 is formed at the end of the lever arm 84 opposite the ends connected to the pawls 78, 80 so that as the flat plate 94 is moved by the assembler, it causes the sides 86, 88 to move the pawls 78, 80, guided within the elongated openings 74, 76 between a locked position and an unlocked position as will be explained. As can be seen, when the pawls 78, 80 are in the locked position, the flat plate 94 is in the horizontal orientation and thus lays flat upon and against the upper, planar surface 58 of the center beam 40 thus providing a physical and visual indication that the pawls 78, 90 are in the locked position.

If, of course, the flat plate 94 is not in the proper horizontal position, the later addition of the box spring will not sit correctly upon the bed frame and is a clear indication to the assembler that the pawls 78, 80 have not been properly secured in their locked position. Since the flat plate 94 therefore serves as a handle for the assembler, there are wings 101 that extend outwardly so that the installer can readily grasp and manipulate the flat plate 94 in attaching and detaching the center beam 40 to a cross bar.

Figure 5:
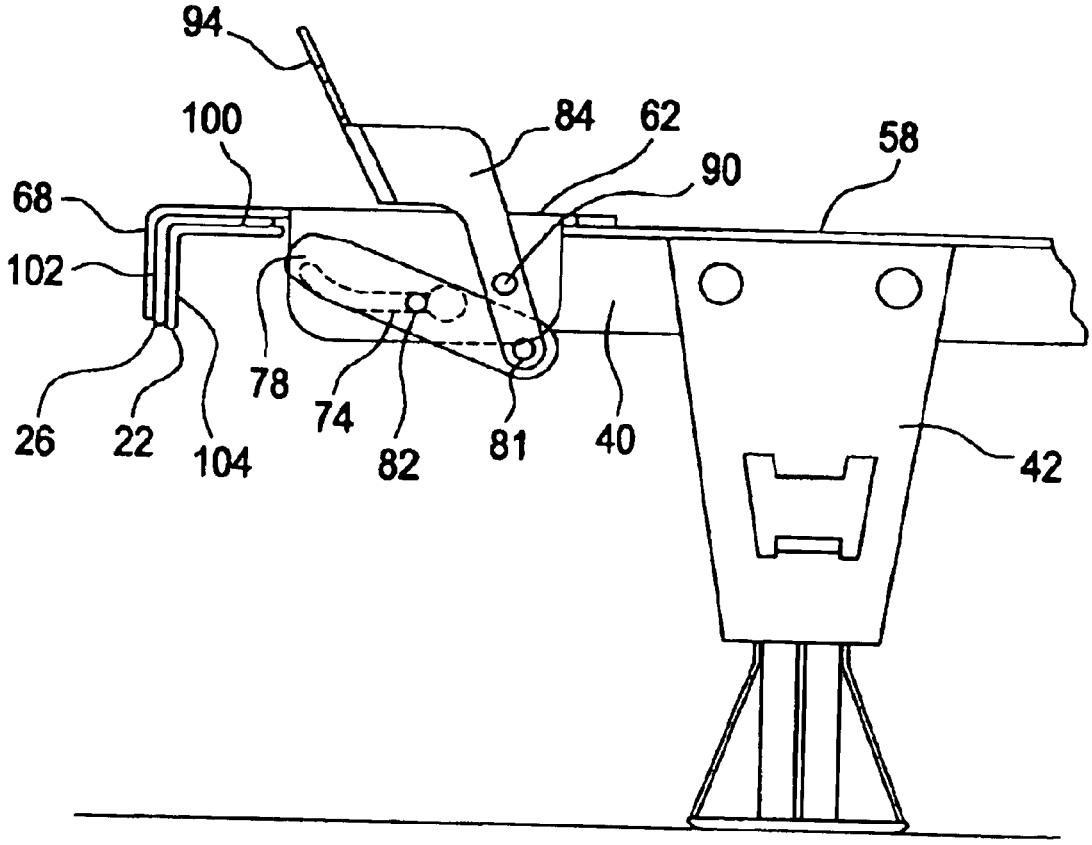
FIGS. 5–7 are side views, partly in section, showing the center beam locking mechanism of the present invention in various stages of operation.
Figure 6:
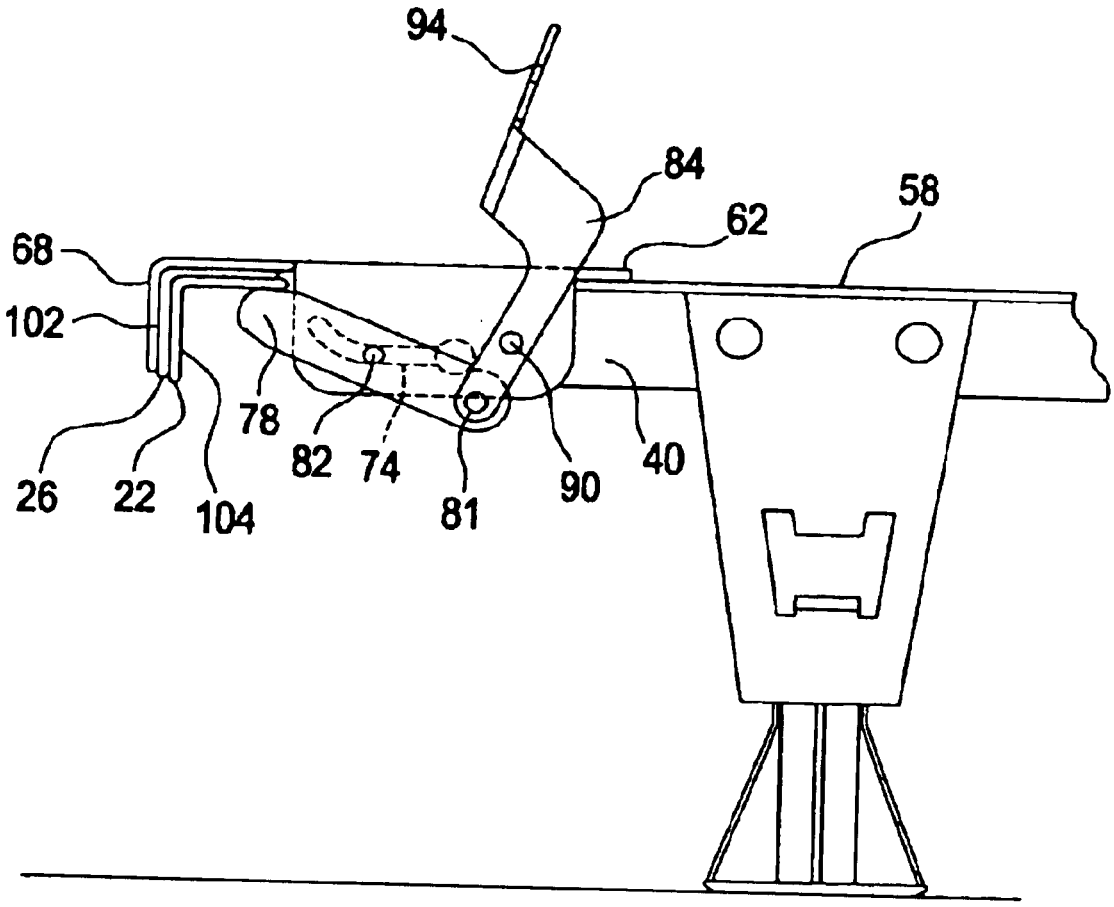
Figure 7:
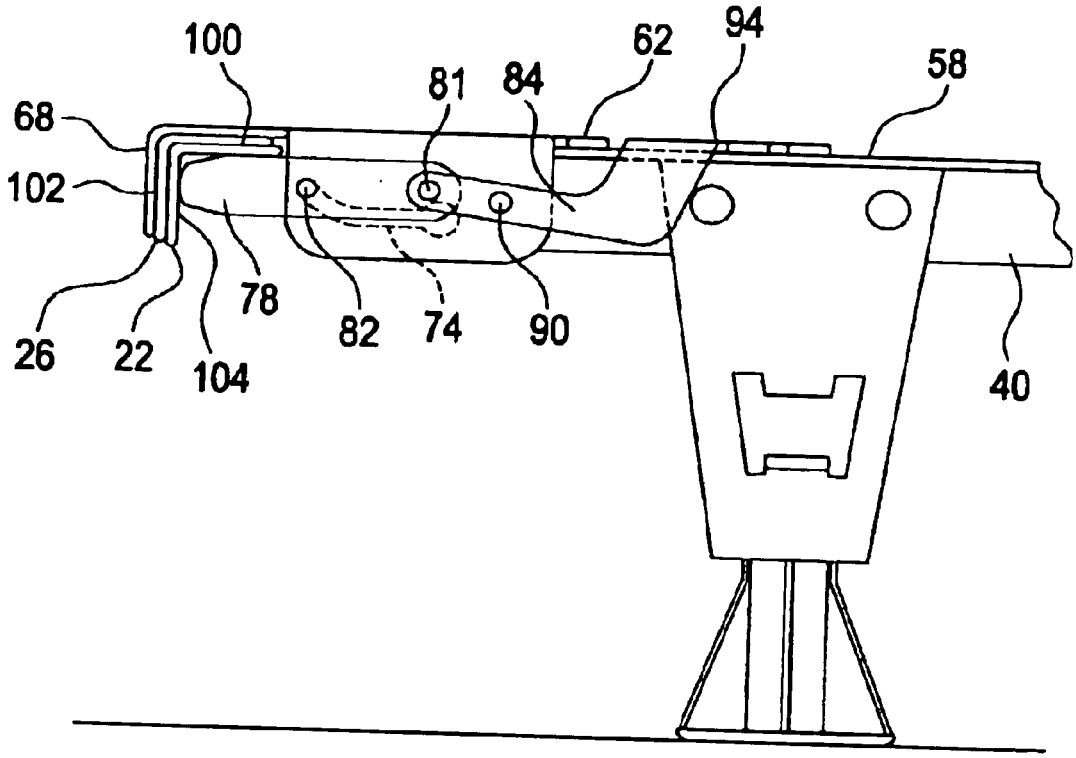

Turning now to FIGS. 5–7, there are shown side views, partly in section, showing the various stages of movement of one of the pawls 78 as it travels between its unlocked position of FIG. 5 to the locked position of FIG. 7, it being understood that the other pawl 80 follows the same pattern of movement. Thus, in FIG. 4, the pawl 78 is in the fully unlocked position, in FIG. 6 the pawl 78 is an intermediate position and in FIG. 7, the pawl 78 is in its locked position. Taking the Figures, there is shown the overlapping, or joined together cross bar members 22, 26 and which are being joined together by the locking mechanism of the present invention.

The FIG. 5–7 embodiment, therefore is exemplary of the queen size, or smaller, bed frame embodiment shown in FIG. 1 and thus the cross bar members 22,26 basically overlap in the affixing of those cross bar members together to form a cross bar 100 and therefore the cross bar 100 is comprised of a double thickness since there is basically a combined thickness of both of the downwardly directed legs of each of the L-shaped steel cross bar members. The cross bar 100 therefore has an external surface 102 and an internal surface 104, however broken down into components, the external surface of the cross bar 100 is the external surface of the cross member 26 while the internal surface of the cross bar 100 is the internal surface of the other cross member 22.

In any event, as shown, the overlapping flange 68 extends around and encompasses the external surface 102 of the cross bar 100 and, as explained, the overlapping flange 68 is sufficient wide so as to present a strong structure and reduce the possibility of twisting between the center beam 40 and the cross bar 100. Thus, in the assembly or affixing of the center beam 40 to the cross bar 100, serially, the flat plate 94 is moved from the position shown in FIG. 5 to the position shown in FIG. 7 and, in doing so, the lever arm 84 pushes pawl 78 toward the cross bar 100 since the lever arm 84 is pivotally affixed to the frame 62 of the locking mechanism at pivot point 90. The movement of the pawl 78 is, of course guided by the projection or standoff rivet 82 that rides within the elongated opening 74 so that the movement of the pawl 78 is controlled as to direction as well as angular movement.

Continuing through the intermediate position of FIG. 6, to the locked position of FIG. 7, there is shown the pawl 78 in its locked position where the double thickness of the angle iron construction of the cross bar 100 is effectively and forcefully sandwiched between the overlapping flange 68 and the distal end of the pawl 78 thereby holding the center beam 40 firmly to the cross bar 100 as well as to prevent relative movement between the cross bar member 22, 26 that could otherwise allow those components to come apart. In the locked position of FIG. 7, it can also be seen that the flat plate 94 rests upon and abutting against the upper planar surface 58 of the cross beam 40 so that the box spring can be assembled to the bed frame with interference.

In addition, by means of the elongated openings 74, 76 that guide the movement of the pawls 78, 80 into the locked position, that locked position of the pawls 78, 80 is maintained by an overcenter relationship, that is, in FIG. 7, the point 81 of attachment of the lever arm 84 to the pawls 78, 80 is above the pivot points 90, 92 of the lever arm 84 such that the pawls 78, 80 are locked into the locked position and cannot inadvertently be moved to the unlocked position without some deliberate force being applied to the flat plate 94 to operate the locking mechanism. Also, of course, the flat plate 94 underlies the box spring and mattress which also applies a downwardly directed, gravitation force on the flat plate 94 to prevent it from moving out of the locked position of the pawls 78, 80.

Accordingly, it can be seen that the aforementioned FIGS. 5–7 that the present locking mechanism is used to securely affix the center beam 40 to the cross bars of the bed frame assembly without the need for screws or, for that matter, any other separate attaching devices and without the need for the assembler to employ any hand tools to fully carry out that assembly.

Figure 8:
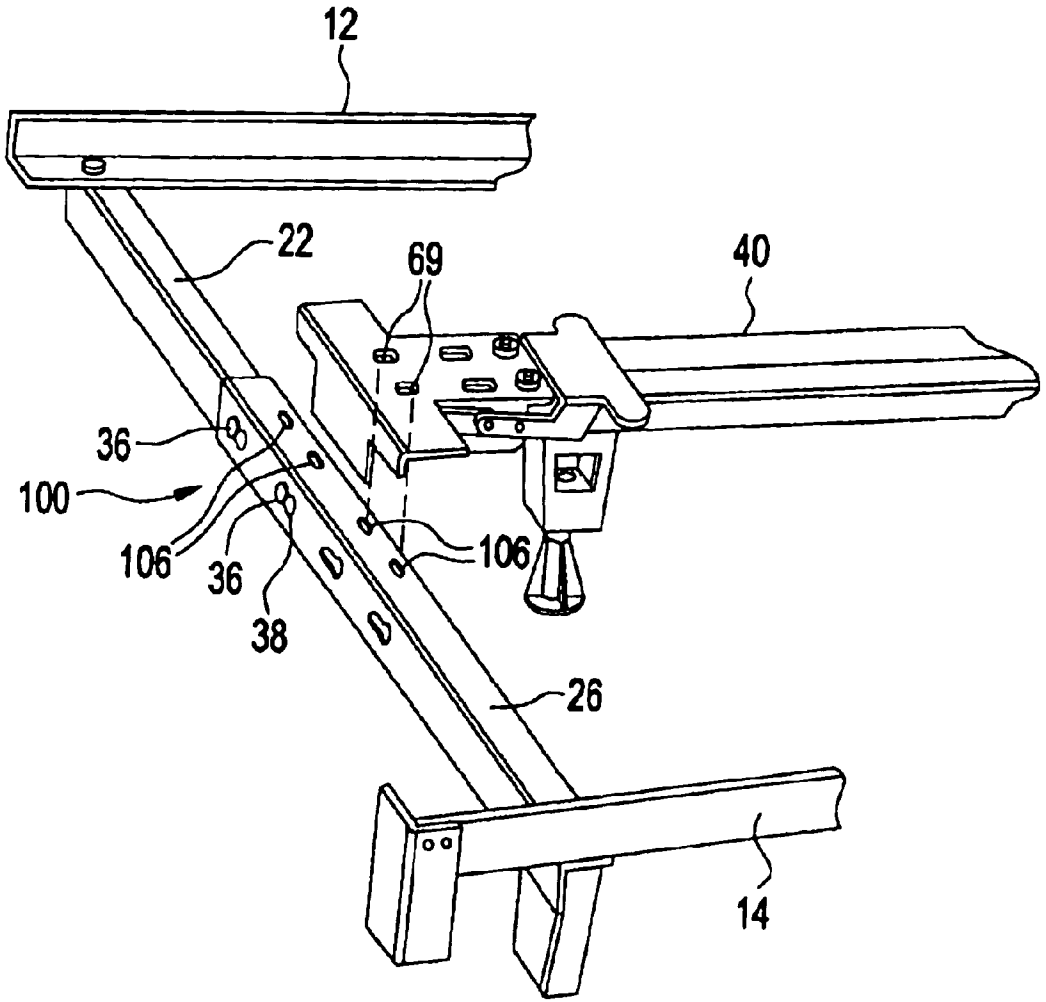
FIG. 8 is a exploded view showing the affixation of a center beam having the center beam locking mechanism of the present invention to a side rail.

Turning now to FIG. 8, there is shown an exploded view of a locking mechanism constructed in accordance with the present invention used to secure the center beam 40 to a cross bar 100. In FIG. 8, the cross bar 100 is formed by the affixing together of the cross bar member 22, 26, again, using, for example, the interlocking of standoff rivets 36 that extend outwardly from the cross bar member 22 and which lock into the keyhole slots 38 formed in the cross bar member 26. As can be seen, there are differing sets of keyhole slots 38 that can be used with the one set of standoff rivets 36 depending on whether the bed frame to be constructed is a queen size or a smaller bed frame. As also can be seen, there are sets of holes 106 formed in the cross bar member 26 and into which are fitted the bent tabs 69 so that the center beam 40 is properly aligned depending upon the particular size of bed frame being assembled.

In the assembly, therefore, of the bed frame in the FIG. 8 embodiment, the cross bar members 22, 26 are interfitted together using the standoff rivets 36 that lock into the set of keyhole slots 38 for the particular configuration of bed frame being assembled and the center beam 40 is affixed to that cross bar 100 by interfitting the bent tabs 69 into the holes 106 and then carrying out the steps depicted in FIGS. 5–7 to lock the center beam 40 to the cross bar 100 without the need for tools or any additional devices.

Figure 9:
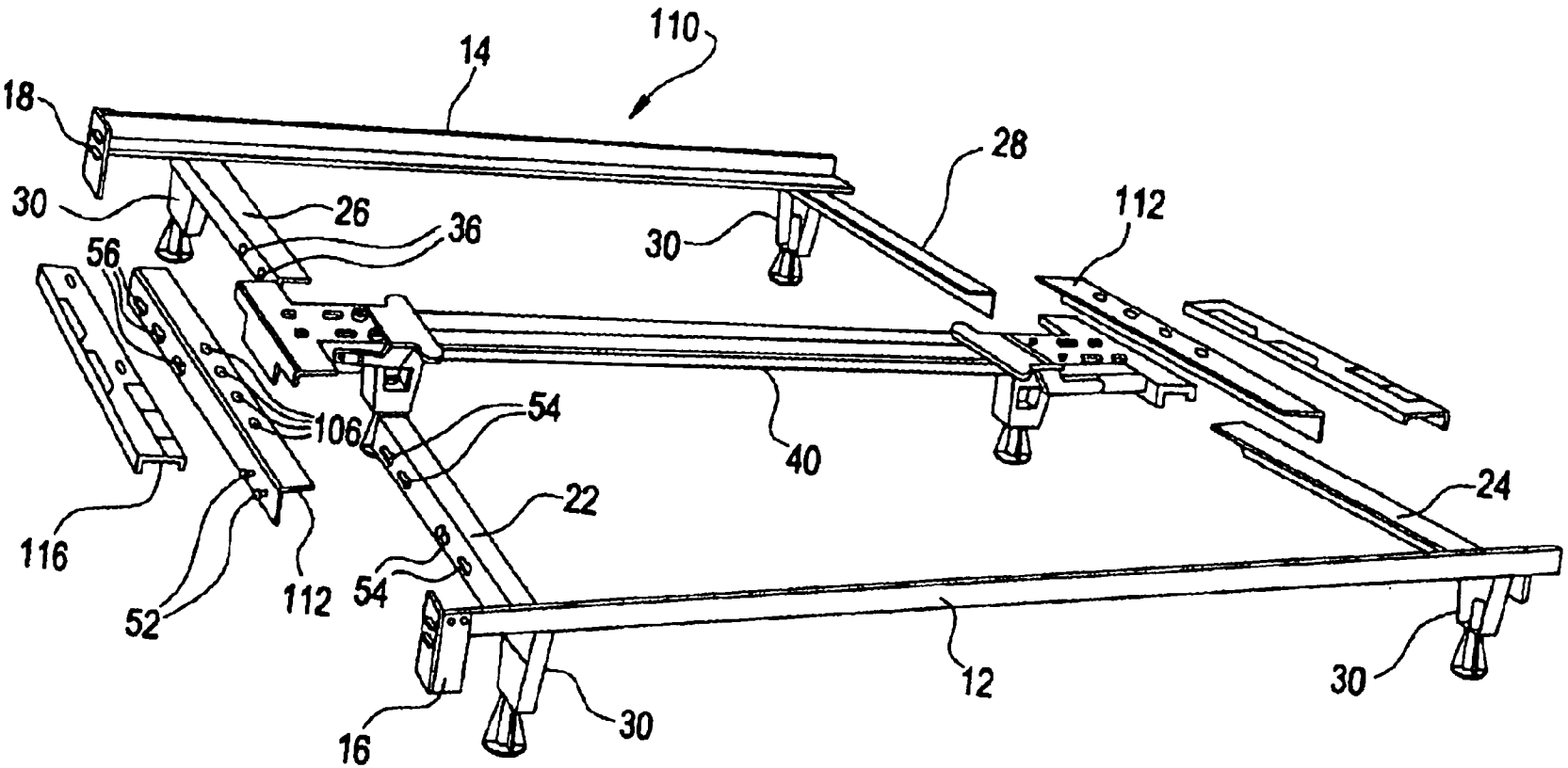
FIG. 9 is an exploded view of a center beam locking mechanism of the present invention used with an extension bar used in the assembly of a king or California king size bed frame.

Turning now to FIG. 9, there is shown an exploded view of a bed frame 110 that is intended for use with king size or California king size beds. In FIG. 9, to the extent some of the components are the same as shown and described with respect to FIG. 2, the same reference numbers have been used. In this embodiment, however, a universal extension bar 112 is shown and which enables the assembler to use the same universal extension bar 112 whether the particular bed frame is intended for use as a king size or a California king size. As such, there are, as is normal, a set of standoff rivets 36 extending outwardly from the cross bar member 26 and sets of keyhole slots 54 formed in the cross bar member 22 as is normal with the conventional frame referred to in FIG. 2. In the case of the FIG. 9 embodiment, however, there can be seen a set of two standoff rivets 52 extending outwardly from the universal extension bar 112 that interfit into the inner set of keyhole slots 54 formed in the cross bar member 22. Although there are two sets of keyhole slots 54 formed in the cross bar member 22, only the inner set are preferable used for the embodiment so as to gain the maximum width of the completed bed frame.

As also seen, there are three keyhole slots 56 in the universal extension bar 112, that is, there is at least one more keyhole slot 56 formed in the universal extension bar 112 than the number of standoff rivets 36 that are intended to interfit into the keyhole slots 56 when the universal extension bar 112 is assembled to join the cross bar members 22 and 26 together. A such, there is more than one location for inserting the standoff rivets 36 into the universal extension bar 112, and, therefore, there may be multiple positions that the universal extension bar 112 can be affixed to the cross bar member 26 depending on the selection by the assembler of a particular set of keyhole slots 56.

Therefore, the universal extension bar 112 can be used as a standard component whether the particular bed frame to be assembled is a king size of a California king size such that it is not necessary for the supplier to stock different extension bars for each of those different sized bed frames but need only stock one extension bar that can be shipped with either of the king or California king size bed frame and thus eliminate the potential problem of the purchaser getting the wrong extension bar for one of those sizes.

There are also a plurality of sets of holes 106 in the upper surface of the universal extension bar 112 that are used to receive the bent tabs 69 (FIG. 4) in order to align the center beam 40 and therefore the assembler has a choice of using more than one set of holes 106 in inserting the bent tabs 69 with the resulting different positions of the center beam 40. Thus, the assembler has a choice of different sets of keyhole slots 56 in the universal extension bar 112 that mate with standoff rivets 36 of the cross bar member 26 depending on whether the bed frame is a king or a California king size bed and then, having made that decision, the assembler has to make a further decision as to which set of holes 106 should be selected to align with the bent tabs 69 in assembling the center beam 40 to the cross bar.

Therefore, in accordance with a further feature of the present invention, there is also provided an extension cap 116, preferably of a molded plastic composition, that includes indicia that guides and instructs the assembler in selecting the correct set of keyhole slots 56 and the correct set of holes 106 to correctly assemble either the king or the California king size bed frame.

Figures 10, 11, 12A, 12B:
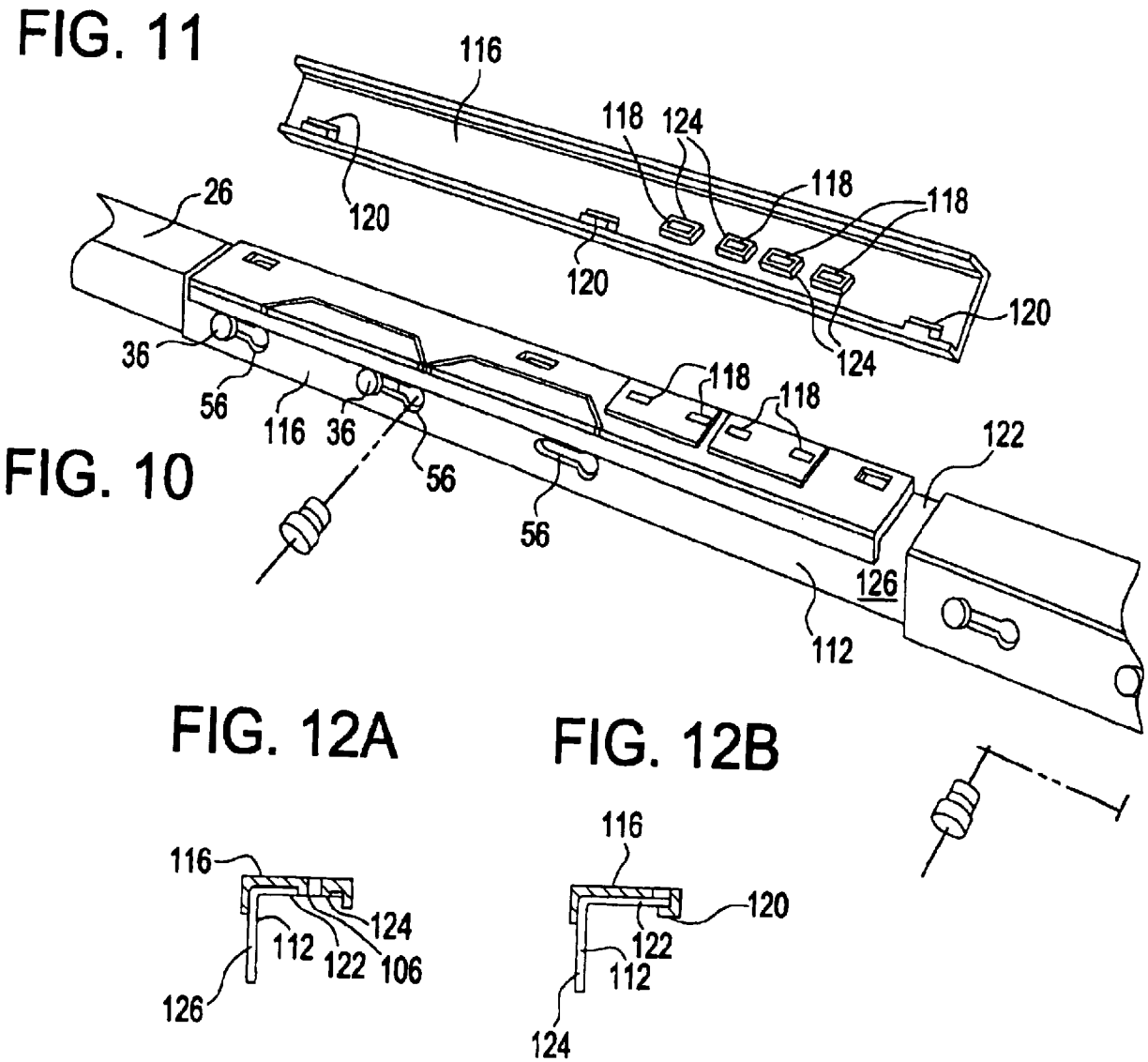
FIG. 10 is a perspective view of an extension cap used in conjunction with the present invention.
FIG. 11 is a perspective view showing the underside of the extension cap of FIG. 10.
FIGS. 12A and 12B are cross sectional views of the extension cap of FIG. 10 affixed in position to an extension bar as used in the present invention.

Turning briefly to FIG. 10, there is a perspective view of a extension cap 116 affixed to the universal extension bar 112 such that the indicia on the extension cap 116 provides the necessary guidance to the assembler as to which keyhole slots 56 are to be used to insert the standoff rivets 36 for each of the king and the California king size bed frames so that the assembler can correctly, and without any experimentation, carry out the correct assembly of the universal extension bar 112 to the cross member 26. Having made that assembly step, there is additional indicia and openings 118 on the extension cap 116 that continue to provide the guidance to the assembler as to which set of holes 106 (FIG. 9) are to be used to insert the bent tabs 69 (FIG. 4) to correctly align the center beam 40 for the proper bed frame size.

Thus, with the use of the extension cap 116, the assembler can properly and without ambiguity, correctly install the universal extension bar 112 and the center beam 40 in the correct position no matter whether the bed frame is a king or a California king size bed frame. It is preferred that the extension cap 116 be simply snapped on to the universal extension bar 112 and, as shown in FIG. 11 which is a perspective view showing the underside of the universal extension bar 112, there are a plurality of locking tabs 120 that snap around the free edge of the upper leg 122 of the L-shaped universal extension bar 112 and the alignment of the extension cap 116 is further assured by projections 124 surrounding the openings 118 in the extension cap 116 and which extend into and fit within the holes 100 (FIG. 9) of the universal extension bar 112. Accordingly, the extension cap 116 can be easily snapped into the proper position onto the universal extension bar 112 and its alignment is assured so that the indica is all in the proper location to guide the assembler in carrying out the assembly of bed frame.

Turning briefly to FIGS. 12A and 12B, there is shown a cross sectional view of the extension cap 116 affixed to the universal extension bar 112 and in FIG. 12A, the extension cap 116 shows the projections 124 extending downwardly into the holes 106 in the universal extension bar 112 to properly align the extension cap 116 to the universal extension bar 112 and in FIG. 12B there is shown one of the locking tabs 120 that snaps over the free end of the upper leg 122 of the L-shaped universal extension bar 112 such that the extension cap 116 can simply be snapped onto the universal extension bar 112 to affix the two components together. As can also be seen in FIGS. 10, 12A and 12B, the addition of the extension cap 116, having a predetermined thickness, when combined with the thickness of the lower leg 126 of the universal extension bar 112 equals the combined thickness of the two overlapping cross bar member 22 and 26, for example, in the FIG. 5–7 embodiments, so that the same locking mechanism can be used with the double thickness of the steel L shaped cross bar member of the queen size and smaller embodiments as with the larger, king and California king size embodiments since the single thickness of the universal extension bar 112 in that latter embodiment is supplemented by the thickness of the extension cap 116 so that the pawls will forcefully retain the center beam 40 to the cross bars in each instance, whether the unit be a queen size or smaller bed frame or a king or California king size bed frame.

Figure 13:
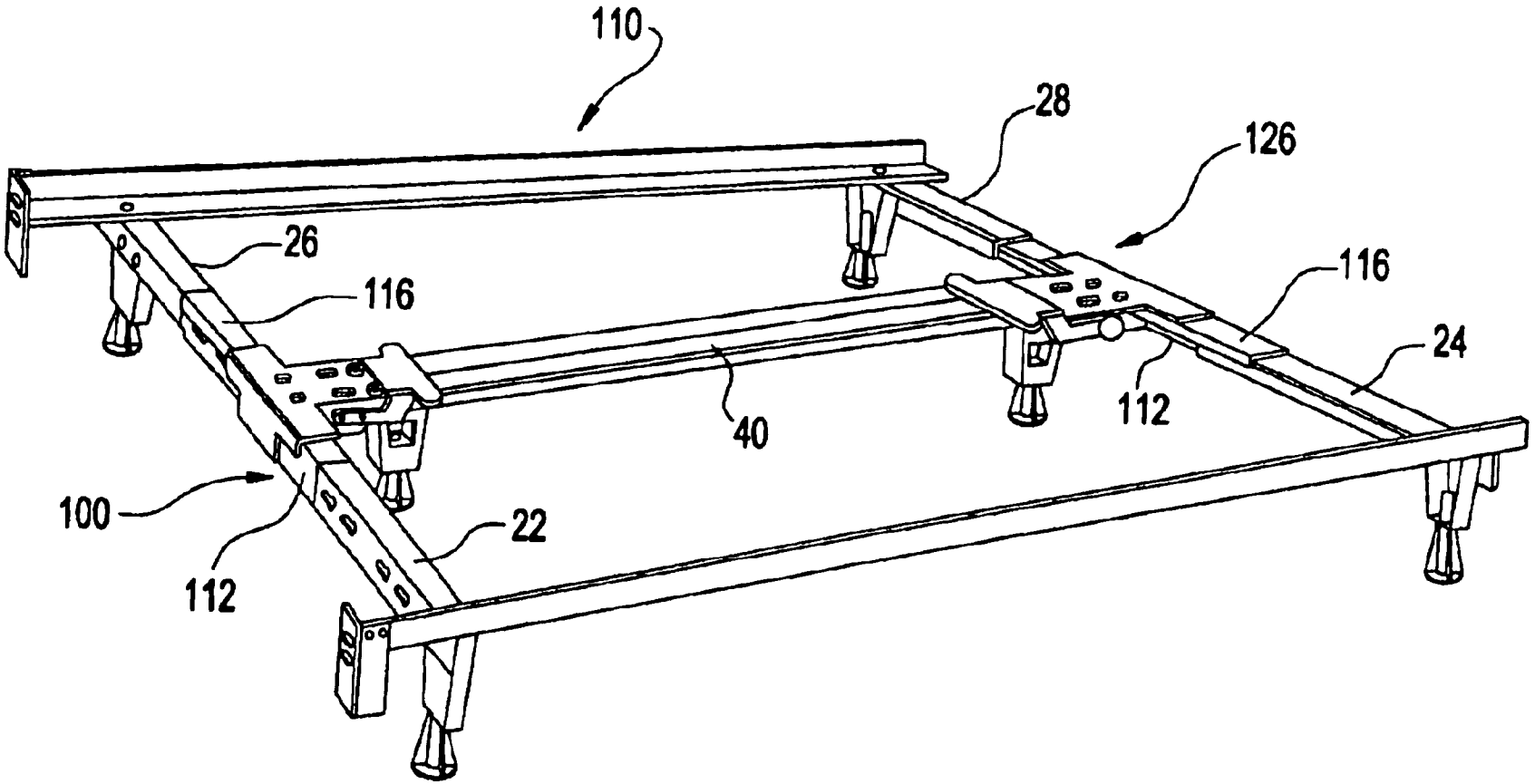
FIG. 13 is a perspective view of the construction of FIG. 9 showing the completed bed frame.

Finally, turning to FIG. 13, there is a perspective view of a completed bed frame 110 for the king size and California king size bed frames. In this FIG., the bed frame 110 has been completely assembled and the center beam 40 is affixed to both of the cross bars 100 and 126. The universal extension bar 112 has, therefore, been secured intermediate each of the cross bar members 22, 26 and 24, 28 by means of the center beam locking mechanism of the present invention and that securing, as well as the full assembly of the bed frame 110 is accomplished without the use of hand tools and all of the action necessary to accomplish the connection can be accessed from the top of the assembly with each comp readily visible to the assembler. The universal extension bar 112 has the extension cap 116 affixed thereto having indicia, by color coding, written indicia or both, to give the necessary instructions to the assembler as to the joining together of the cross bar members as well as to additional assembly of the center beam.

While the present invention has been set forth in terms of a specific embodiment of embodiments, it will be understood that the present center beam locking mechanism herein disclosed may be modified or altered by those skilled in the art to other configurations. Accordingly, the invention is to be broadly construed and limited only by the scope and spirit of the claims appended hereto.

For example, while the invention has been described with reference to a bed frame, it can be appreciated that the invention can be used in many applications where two members are desired to be affixed together, including, but not limited to, scaffolding, shelving systems, racks, hatch covers, door latches, tie down devices, containers, ladders, fasteners and connecting devices in general.

What is claimed is:

1. A locking mechanism for affixing a center beam of a bed frame to a cross bar having an external surface and an internal surface, the locking mechanism adapted to be affixed to an end of the center beam, the locking mechanism comprising a frame having an overlapping flange adapted to overlap the external surface of a cross bar, and at least one pawl movable between a locked position wherein the at least one pawl contacts the internal surface of the cross bar to firmly sandwich the cross bar between the overlapping flange and the at least one pawl and an unlocked position wherein the at least one pawl is displaced away from the internal surface of the cross bar.

2. The locking mechanism as defined in claim 1 wherein the at least one pawl comprises a plurality of pawls.

3. The locking mechanism as defined in claim 1 where the locking mechanism frame is generally a downwardly facing U shape frame surrounding the end of the center beam and having downwardly projecting faces.

4. The locking mechanism as defined in claim 3 wherein the downwardly projecting faces each have an elongated opening therein.

5. The locking mechanism as defined in claim 3 wherein the at least one pawl comprises two pawls located external and generally abutting the downwardly projecting faces, and wherein each of the pawls has a projection adapted to ride within one of the elongated openings to guide the movement of the pawls between the locked and the unlocked positions.

6. The locking mechanism as defined in claim 4 wherein the elongated opening in each of the downwardly projecting faces is a generally J-shaped opening.

7. The locking mechanism as defined in claim 1 wherein the locking mechanism further includes an over center mechanism having a flat plate operable by a user to move the at least one pawl between the locked and unlocked position.

8. The locking mechanism as defined in claim 7 wherein the flat plate is adapted to be located flat against a center beam when the at least one pawl is in the locked position.

9. The locking mechanism as defined in claim 7 wherein the flat plate has wings extending outwardly therefrom for to enable a user to readily grasp the flat plate.

10. A bed frame assembly comprising side rails and having cross bars interconnecting said side rails, each of the cross bars having an external surface and an internal surface, a center beam affixed between the cross bars, the center beam having a locking mechanism at an end of the center beam adapted to affix the center beam to the cross bars, said locking mechanism comprising a flange adapted to contact the external surface of the cross bars, and at least one pawl movably between a locked position wherein said at least one pawl bar contacts the internal surface of the cross bars to firmly sandwich the cross bars between the flange and the at least one pawl bar and an unlocked position where the at least one pawl is displaced away from the internal surface of the cross bars.

11. The bed frame assembly as defined in claim 10 wherein the at least one pawl comprises a plurality of pawls.

12. The bed frame assembly as defined in claim 10 wherein the locking mechanism comprises a frame and the flange is formed integral with the frame.

13. The bed frame assembly as defined in claim 11 wherein the frame has a U shaped configuration, having two, spaced apart sides projecting downwardly from the frame.

14. The bed frame assembly as defined in claim 13 wherein the at least one pawl comprises two pawls, each of the pawls being located external of the spaced apart sides, and where each of the spaced apart sides has an elongated opening formed therein.

15. The bed frame assembly as defined in claim 14 wherein the elongated opening in each of the downwardly projecting faces is a generally J-shaped opening.

16. The bed frame assembly as defined in claim 14 wherein each of the pawls has a projection that rides within the elongated opening in each of the spaced apart sides to guide and control the movement of the pawls moving between the locked and unlocked positions.

17. The bed frame assembly as defined in claim 10 wherein each of the cross bars comprises two cross bar members, each of the cross bar members having one end thereof pivotally affixed to the ends of the side rails and having the other free end affixed to a corresponding cross bar member of the other side rail, and the locking mechanism prevents the cross bar members from moving relative to each other when the at least one pawl is in the locked position.

18. An extension bar for joining two free ends of a cross member together in forming a bed frame, the extension bar having a joining means located at each end of said extension bar to enable the extension bar to be affixed to the free ends of the cross members, the extension bar having an extension cap affixed thereto, the extension cap having indicia provided thereon to provide instructions as to the joining of at least one of the cross members to the extension bar.

19. The extension bar as defined in claim 18 wherein said indicia comprises written words.

20. The extension bar as defined in claim 18 wherein the extension cap has a means to align the extension cap to the extension bar.

21. The extension bar as defined in claim 18 wherein the extension bar has a plurality of holes formed therein and the extension cap has at least one protrusion extending therefrom said alignment means comprises interfitting the at least one protrusion into a selected one of the plurality of holes.

22. The extension bar as defined in claim 18 wherein the extension cap is adapted to snap onto said extension bar.

23. A bed frame assembly, said bed frame assembly comprising a pair of side rails, cross bars joining the side rail to make up a generally rectangular bed frame assembly, and a center beam affixed to the cross members and oriented generally parallel to the side rails, each of the cross bars comprising a pair of cross bar members having one end of each of the cross bar members affixed to the side rails and having a free end, a universal extension bar joining the free ends thereof, the free ends of the cross bar members and the extension bar having mating connector means adapted to interconnect the free ends of the cross bar members with the extension bar, the center beam having a locking mechanism to affix the center beam to each of the cross bars, the locking mechanism comprising a frame having an overlapping flange adapted to overlap the external surface of a cross bar, and at least one pawl movable between a locked position wherein the pawl contacts the internal surface of the cross bar to firmly sandwich the cross bar between the overlapping flange and the at least one and an unlocked position wherein the pawl is displaced away from said the internal surface of the cross bar, the locking mechanism frame further having at least one bent tab extending downwardly from each of said ends of the cross beam and the extension bar having at least one hole for receiving the at least one bent tab, the interconnection of the at least one bent tab and the at least one hole adapted to provide the proper orientation of the center beam with the bed frame assembly.

24. The bed frame assembly as defined in claim 23 wherein the mating connector means affixing a cross bar member with an extension bar has a plurality of mating positions depending upon the desired size of the completed bed frame assembly.

25. The bed frame assembly as defined in claim 24 wherein the mating connector means comprises a plurality of standoff rivets or keyhole slots formed on the cross member, and a plurality of keyhole slots or standoff rivets formed on the extension bar, respectively, wherein there are multiple positions for affixing the cross bar member to the extension bar.

26. The bed frame assembly as defined in claim 25 wherein said extension bar has indicia in order to provide information as to the proper one of the multiple positions to form the desired size of the completed bed frame assembly.

27. The bed frame assembly as defined in claim 26 wherein the indicia is formed on an extension cap affixed to the extension bar.

28. The bed frame assembly as defined in claim 27 wherein the extension cap is snapped onto the extension bar.

29. The bed frame assembly as defined in claim 23 wherein the locking mechanism comprises a downwardly extending tab and the extension bar has formed therein a plurality of holes adapted to receive the tab, the tab adapted to enter one of the plurality of holes to align the center beam in multiple positions depending on the desired size of the completed bed frame assembly.

30. The bed frame assembly as defined in claim 29 wherein the plurality of holes in said extension bar comprises a plurality of sets of holes and the tab comprises a set of tabs.

31. The bed frame assembly as defined in claim 29 wherein the extension bar has indicia in order to provide information as to the proper one of the plurality of holes to receive the tab to form the desired size of the completed bed frame assembly.

32. The bed frame assembly as defined in claim 31 wherein said indicia is formed on a extension cap affixed to said extension bar.

33. The bed frame assembly as defined claim 32 wherein the extension cap is snapped on to the extension bar.

34. The bed frame assembly as defined claim 32 wherein the extension cap is comprised of a molded plastic material.

35. The bed frame assembly as defined claim 31 wherein the extension cap has an alignment means to align the affixation of the extension cap with the extension bar.

36. The bed frame assembly as defined claim 35 wherein the alignment means comprises at least one projection extending from the extension cap to interfit within at least one of the holes in the extension bar.

37. A locking mechanism means for affixing a first structural member to a second structural member having an external surface and an internal surface, the locking mechanism comprising a frame affixed to the first structural member, the frame having an overlapping flange adapted to overlap the external surface of the second structural member and at least one pawl movable between a locked position wherein the pawl contacts the internal surface of the second structural member to firmly sandwich the second structural member between the overlapping flange and the atg least one pawl and an unlocked position wherein the at least one pawl is displaced away from the internal surface of the second structural member.

38. The locking mechanism as defined in claim 37 wherein the at least one pawl comprises a plurality of pawls.

39. The locking mechanism as defined in claim 37 where the locking mechanism frame is generally a downwardly facing U shape frame surrounding the end of the first structural member and having downwardly projecting faces.

40. The locking mechanism as defined in claim 39 wherein the downwardly projecting faces each have an elongated opening therein.

41. The locking mechanism as defined in claim 40 wherein the elongated opening in each of the downwardly projecting faces is a generally J-shaped opening.

42. The locking mechanism as defined in claim 39 wherein the at least one pawl comprises two pawls located external and generally abutting the downwardly projecting faces, and wherein each of the pawls has a projection adapted to ride within one of the elongated openings to guide the movement of the pawls between the locked and the unlocked positions.

43. The locking mechanism as defined in claim 37 wherein the locking mechanism further includes an over center mechanism having a handle operable by a user to move the at least one pawl between the locked and unlocked position.

* * * * *